US006646518B2

(12) United States Patent
Tajima

(10) Patent No.: US 6,646,518 B2
(45) Date of Patent: Nov. 11, 2003

(54) BALUN AND SEMICONDUCTOR DEVICE INCLUDING THE BALUN

(75) Inventor: Minoru Tajima, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 58 days.

(21) Appl. No.: 09/977,350

(22) Filed: Oct. 16, 2001

(65) Prior Publication Data

US 2002/0196096 A1 Dec. 26, 2002

(30) Foreign Application Priority Data

Jun. 22, 2001 (JP) ..... 2001-190340

(51) Int. Cl.[7] ..... H01P 5/10
(52) U.S. Cl. ..... 333/26; 333/34
(58) Field of Search ..... 333/26, 34, 33, 333/170, 169

(56) References Cited

U.S. PATENT DOCUMENTS 3,523,260 A * 8/1970 Gunshinan et al. ..... 333/26
4,125,810 A * 11/1978 Pavio ..... 455/327
5,119,048 A * 6/1992 Grunwell ..... 333/34
5,821,815 A * 10/1998 Mohwinkel ..... 330/286
6,140,886 A * 10/2000 Fratti et al. ..... 333/26
6,175,084 B1 * 1/2001 Saitoh et al. ..... 174/252
6,201,439 B1 * 3/2001 Ishida et al. ..... 330/124 R

FOREIGN PATENT DOCUMENTS

JP 09-046106 2/1997

* cited by examiner

*Primary Examiner*—Robert Pascal
*Assistant Examiner*—Dean Takaoka
(74) *Attorney, Agent, or Firm*—Burns, Doane, Swecker & Mathis, LLP

(57) ABSTRACT

A balun includes a first conductive layer disposed on a top surface of a substrate, a second conductive layer having a shorter length than the first conductive layer and disposed on the top surface of the substrate, the second conductive layer having first and second end portions, a substrate having a through hole electrically connected to the second end portion of the second conductive layer, and a third conductive layer disposed on a bottom surface of the substrate, the third conductive layer having a first end portion electrically connected to the second end portion of the second conductive layer via the through hole, and the third conductive layer being tapered from a maximum width at the second end portion thereof to a minimum width at the first end portion thereof.

19 Claims, 12 Drawing Sheets

BALUN AND SEMICONDUCTOR DEVICE INCLUDING THE BALUN

BACKGROUND OF THE INVENTION

1. Field of the Invention

The present invention relates to a balun used to connect a balanced transmission line to an unbalanced transmission line and a semiconductor device provided with the balun.

2. Description of the Prior Art

A balun that operates in a low frequency band and is used to connect a balanced transmission line to an unbalanced line consists of a concentrated constant component such as a transformer, whereas a balun that operates in a high-frequency microwave band consists of a distributed constant component. Since most of baluns each of which consists of a distributed constant component include a quarter-wavelength matching element or are transformers whose size is determined according to usable wavelengths, a disadvantage to them is that their frequency bands are fundamentally narrow.

FIG. 23 is a perspective view showing the structure of a prior art balun 100 which is in practical use and operates in a microwave band, the balun having small wavelength dependence and a large frequency band. In the figure, reference numeral 101 denotes a first conductive layer that is tapered, and reference numeral 102 denotes a second conductive layer that is tapered.

As shown in FIG. 23, the first conductive layer 101 is tapered from a maximum width at an end portion 101*a* thereof to a minimum width at another end portion 101*b* thereof, and the second conductive layer 102 is tapered from a maximum width at an end portion 102*a* thereof to a minimum width at another end portion 102*b* thereof. The taper of each of the first and second conductive layers 101 and 102 can be a linear taper. As an alternative, the taper of each of the first and second conductive layers 101 and 102 can be, as to shifting characteristic impedance, an exponential taper, a triangular taper, a Klopfenstein taper, or any other taper which can reduce the amount of reflection while transforming the characteristic impedance of a balanced transmission line into the characteristic impedance of an unbalanced transmission line over a large frequency band. Furthermore, in order to hold the spacing between the first and second conductive layers 101 and 102, they are usually formed on both sides of a dielectric substrate such as a printed board (not shown in the figure), respectively.

In operation, the balun 100 connects an unbalanced line coupled to the end portions 101*a* and 102*a* of the first and second conductive layers 101 and 102 to a balanced line coupled to the other end portions 101*b* and 102*b*, and also transforms the characteristic impedance of the unbalanced line to the characteristic impedance of the balanced line. In order to minimize the amount of reflection due to changes in the characteristic impedance of the balun, the taper of each of the first and second conductive layers 101 and 102 can be optimized.

By the way, it is possible to easily connect a coaxial connector to the end portions 101*a* and 102*a* on the unbalanced-line side of the balun 100 shown in FIG. 23 because the pair of the end portions 101*a* and 102*a* is a normal microstrip line, but since the end portions 101*b* and 102*b* on the balanced-line side of the balun are formed on the both sides of a substrate not shown in the figure, respectively, it is difficult to physically connect them to a pair of balanced terminals, which is formed on an electronic component, such as an IC, and which is arranged in the same plane of the substrate.

Therefore, in order to connect an electronic component, such as an IC, which has a pair of balanced output terminals in the same plane, to another electronic component having a pair of unbalanced input terminals, one of the pair of balanced output terminals is connected to a grounded surface of the substrate by way of a termination. On the other hand, the other one of the balanced output terminal pair is connected to one unbalanced input terminal of the other electronic component by way of a microstrip line.

FIG. 24 is a plan view showing the structure of a prior art balun 200 which can be incorporated into a power amplifier for use with television broadcasting transmitters as disclosed in Japanese patent application publication (TOKKAIHEI) No. 9-46106. FIG. 25 is a bottom view of the balun 200. In the figure, reference numeral 201 denotes a first conductive layer formed on a top surface of a printed board 220, and reference numeral 202 denotes a second conductive layer formed on a bottom surface of the printed board 220. These conductive layers 201 and 202 form a broadside-coupling-type line and constitute an isolation transformer 203. The first and second conductive layers 201 and 202, which constitute the isolation transformer 203, both have a predetermined width. Reference numeral 204 denotes a high-frequency signal input terminal to which an end of the first conductive layer 201 is connected, reference numeral 205 denotes an output terminal to which another end of the first conductive layer 201 is connected, reference numeral 206 denotes a output terminal to which the end of the second conductive layer 202 is electrically connected via a through hole 210, reference numerals 207*a* and 207*b* denote third and fourth conductive layers with a ground potential, reference numeral 208 denotes a fifth conductive strip layer that connects the first conductive layer 201 to the third conductive layer 207*a* and that functions as an inductance, and reference numeral 209 denotes a sixth conductive layer that is formed in the form of a strip and that connects the second conductive layer 202 to the fourth conductive layer 207*b* and functions as an inductance. A push-pull circuit transistor (not shown in the figure) for use in power amplifiers is connected to the pair of output terminals 205 and 206.

In the prior art balun constructed as shown in FIGS. 24 and 25, a high-frequency signal, which is applied to the high-frequency signal input terminal 204 by way of a microstrip line which is an unbalanced line, flows through the first and second conductive layers 201 and 202 which constitute the isolation transformer 203, as a pair of two equal-amplitude currents 180 degrees out of phase with each other. One of the electric current pair is supplied from the first conductive layer 201, by way of the output terminal 205, to one terminal of a push-pull circuit transistor (not shown in the figure) for use in power amplifiers, and the other one of the electric current pair is supplied from the second conductive layer 202, by way of the through hole 210 and the output terminal 206, to another terminal of the push-pull circuit transistor.

A problem with prior art baluns that operate in a microwave band constructed as above is that although conductive layers have to be tapered in order to provide small wavelength dependence and a large frequency band, it is difficult to make a physical connection between a balun including such conductive layers and an electronic circuit, such as an IC, having a pair of balanced terminals, as previously mentioned. Another problem is that when one of the pair of balanced terminals is connected to a ground by way of a termination, the efficiency is reduced because the other one of the pair of balanced outputs is not used, and the load on a differential circuit that generates a pair of balanced outputs becomes unbalanced because of an inductance included in the termination which increases with increasing frequency, which results in a malfunction of the differential circuit.

Furthermore, a problem with the prior art balun as disclosed in Japanese patent application publication No. 9-46106 shown in FIGS. 24 and 25 is that the pattern of the conductive layers is complex and the balun is not suitable for use with a connection of a balanced line with an unbalanced line over a wide frequency band requested by 40 Gbps optical communication.

SUMMARY OF THE INVENTION

The present invention is proposed to solve the above-mentioned problems, and it is therefore an object of the present invention to provide a broadband balun with a simple structure that facilitates a connection of itself with a pair of balanced terminals of an electronic circuit disposed in the same plane of a substrate, and a semiconductor device provided with the balun.

In accordance with an aspect of the present invention, there is provided a balun comprising: a first conductive layer disposed on a top surface of a substrate, the first conductive layer having first and second end portions; a second conductive layer having a shorter length than the first conductive layer and disposed on the top surface of the substrate, the second conductive layer having first and second end portions, the first end portion of the second conductive layer serving as a balanced transmission line in cooperation with the first end portion of the first conductive layer; the substrate having a through hole electrically connected to the second end portion of the second conductive layer; and a third conductive layer disposed on a bottom surface of the substrate, the third conductive layer having a first end portion electrically connected to the second end portion of the second conductive layer via the through hole, and a second end portion that serves as an unbalanced transmission line in cooperation with the second end portion of the first conductive layer, and the third conductive layer being tapered from a maximum width at the second end portion thereof to a minimum width at the first end portion thereof. Accordingly, the balun can transform balanced mode into unbalanced mode over a wide frequency range. The balun can also facilitate the connection of itself with an electronic circuit, such as an IC, having a pair of balanced output terminals in the same plane of the substrate.

In accordance with another aspect of the present invention, the taper of the third conductive layer is a curved taper.

In accordance with a further aspect of the present invention, the taper of the third conductive layer is a Klopfenstein taper as to shifting characteristic impedance.

In accordance with another aspect of the present invention, the first end portion of the third conductive layer has a width smaller than that of the second end portion of the second conductive layer.

In accordance with a further aspect of the present invention, the third conductive layer includes a strip segment having a certain width smaller than that of the second end portion of the second conductive layer, and extending from the first end portion of the third conductive layer.

In accordance with another aspect of the present invention, the second end portion of the third conductive layer has a width that is at least from four to five times as large as that of the second end portion of the first conductive layer.

In accordance with a further aspect of the present invention, the second end portion of the third conductive layer has a width that is substantially equal to a diameter of an outer conductor of a coaxial cable to be electrically connected to the second end portion of the third conductive layer.

In accordance with another aspect of the present invention, the third conductive layer has a length equal to or greater than one-half of a wavelength of a microwave to be transmitted through the balun.

In accordance with a further aspect of the present invention, there is provided a balun comprising: a first conductive layer disposed on a top surface of a substrate, the first conductive layer having first and second end portions, and the first conductive layer being tapered from a maximum width at the second end portion thereof to a minimum width at the first end portion thereof; a second conductive layer having a shorter length than the first conductive layer and disposed on the top surface of the substrate, the second conductive layer having first and second end portions, the first end portion of the second conductive layer serving as a balanced transmission line in cooperation with the first end portion of the first conductive layer; the substrate having a through hole electrically connected to the second end portion of the second conductive layer; and a third conductive layer disposed on a bottom surface of the substrate, the third conductive layer having a first end portion electrically connected to the second end portion of the second conductive layer via the through hole, and a second end portion that serves as an unbalanced transmission line in cooperation with the second end portion of the first conductive layer.

In accordance with another aspect of the present invention, the taper of the first conductive layer is a curved taper.

In accordance with a further aspect of the present invention, there is provided a balun comprising: first and second substrates that are laminated; a first conductive layer disposed between the first and second substrates, the first conductive layer having first and second end portions; a second conductive layer having a shorter length than the first conductive layer and disposed between the first and second substrates, the second conductive layer having first and second end portions, the second end portion of the second conductive layer serving as a balanced transmission line in cooperation with the first end portion of the first conductive layer; the laminated first and second substrate having a through hole electrically connected to the second end portion of the second conductive layer; a third conductive layer disposed on a top surface of the laminated first and second substrates, the third conductive layer having a first end portion electrically connected to the second end portion of the second conductive layer via the through hole, and a second end portion that serves as an unbalanced triplate transmission line in cooperation with the second end portion of the first conductive layer, and the third conductive layer being tapered from a maximum width at the second end portion thereof to a minimum width at the first end portion thereof; and a fourth conductive layer disposed on a bottom surface of the laminated first and second substrates, the fourth conductive layer having a first end portion electrically connected to the second end portion of the second conductive layer via the through hole, and a second end portion that serves as the unbalanced triplate transmission line in cooperation with the second end portion of the first conductive layer and the second end portion of the third conductive layer, and the fourth conductive layer being tapered from a maximum width at the second end portion thereof to a minimum width at the first end portion thereof. Accordingly, the balun can transform balanced mode into unbalanced mode over a wide frequency range. The balun can also facilitate the connection of itself with an electronic circuit, such as an IC, having a pair of balanced output terminals in the same plane between the laminated substrates having a triplate structure.

In accordance with another aspect of the present invention, each of the tapers of the third and fourth conductive layers is a curved taper.

In accordance with a further aspect of the present invention, each of the first end portions of the third and fourth conductive layers has a width smaller than that of the second end portion of the second conductive layer.

In accordance with another aspect of the present invention, there is provided a semiconductor device comprising: an electronic circuit disposed on a top surface of a substrate, the circuit having a pair of balanced terminals; a balun formed on the substrate, for connecting the pair of balanced terminals to an unbalanced transmission line, the balun including a first conductive layer disposed on the top surface of the substrate, the first conductive layer having a first end portion connected to a terminal of the pair of balanced output terminals of the electronic circuit, and a second end portion, a second conductive layer having a shorter length than the first conductive layer and disposed on the top surface of the substrate, the second conductive layer having a first end portion connected to the other terminal of the pair of balanced output terminals of the electronic circuit, and a second end portion, the substrate having a through hole electrically connected to the second end portion of the second conductive layer, and a third conductive layer disposed on a bottom surface of the substrate, the third conductive layer having a first end portion electrically connected to the second end portion of the second conductive layer via the through hole, and a second end portion that serves as the unbalanced transmission line in cooperation with the second end portion of the first conductive layer, and the third conductive layer being tapered from a maximum width at the second end portion thereof to a minimum width at the first end portion thereof; and an electronic module mounted on the substrate, for transmitting or receiving a signal to or from the electronic circuit by way of the balun. Accordingly, the balun according to the present invention makes it possible to effectively use outputs from the pair of balanced output terminals of the electronic circuit without connecting one of the pair of balanced output terminals to a grounded surface of the substrate by way of a termination, thereby preventing the operating status of the electronic circuit from becoming unstable, and improving the efficiency of the semiconductor device.

In accordance with a further aspect of the present invention, the semiconductor device further comprises a coaxial cable for electrically connecting the balun to the electronic module.

In accordance with another aspect of the present invention, the electronic module is electrically insulated from a ground of the substrate.

In accordance with a further aspect of the present invention, the electronic module transmits or receives a high-frequency signal to or from the electronic circuit by way of the balun, and a high-frequency signal line of the electronic module is electrically insulated from the ground of the substrate.

In accordance with another aspect of the present invention, the electronic module is connected to the substrate by way of an insulating member.

In accordance with a further aspect of the present invention, the electronic module is an optical module driven by a pair of signals supplied, by way of the balun, from the electronic circuit.

Further objects and advantages of the present invention will be apparent from the following description of the preferred embodiments of the invention as illustrated in the accompanying drawings.

BRIEF DESCRIPTION OF THE DRAWINGS

FIG. 6(*b*) is a side view showing mounting of an optical module included in the semiconductor device on a substrate;

DETAILED DESCRIPTION OF THE PREFERRED EMBODIMENTS

Hereafter, preferred embodiments of the present invention will be explained.

Embodiment 1

Figure 1:
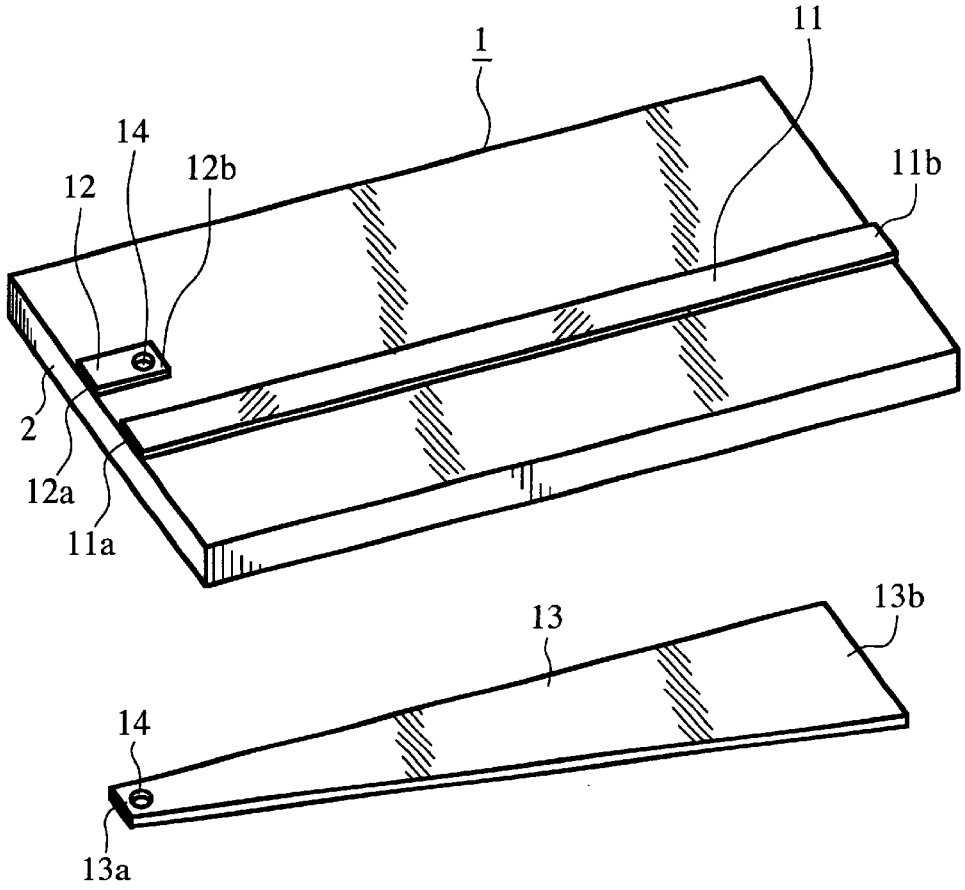
FIG. 1 is a perspective view showing the structure of a balun according to a first embodiment of the present invention.

FIG. 1 is a perspective view showing the structure of a balun according to a first embodiment of the present invention. In the figure, reference numeral 1 denotes a balun, reference numeral 2 denotes a dielectric substrate (abbreviated as substrate from here on) such as a printed board, reference numeral 11 denotes a first conductive layer that is formed in the form of a strip and is disposed on a top surface of the substrate 2, reference numeral 12 denotes a second conductive layer that is formed in the form of a strip and is disposed on the top surface of the substrate 2 in parallel with the first conductive layer 11, the second conductive layer 12 having a shorter length than the first conductive layer 11, and reference numeral 13 denotes a third conductive layer that is tapered and is disposed on a bottom surface of the substrate 2 and that is electrically connected to the second conductive layer 12 via a through hole 14 penetrating the substrate 2.

Figure 2:
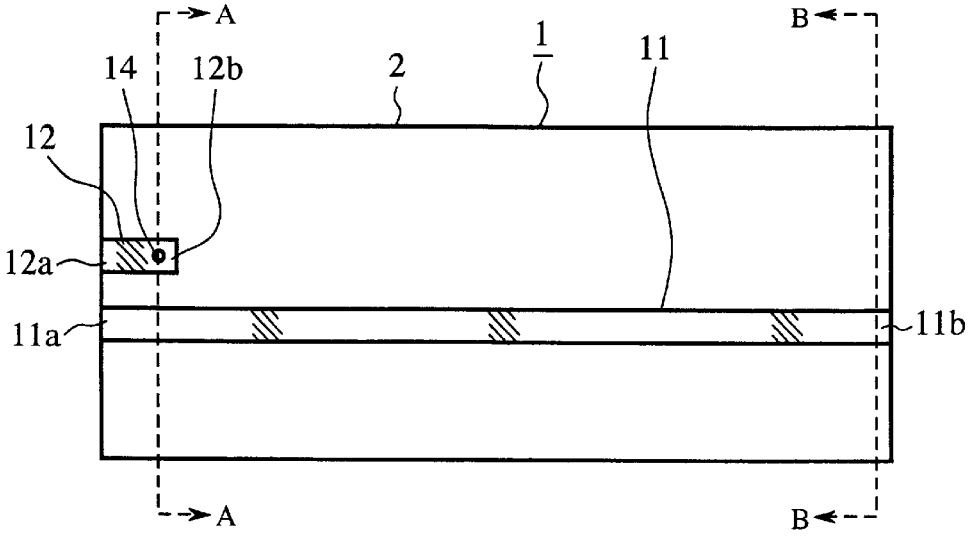
FIG. 2 is a plan view of the balun according to the first embodiment shown in FIG. 1.
Figure 3:
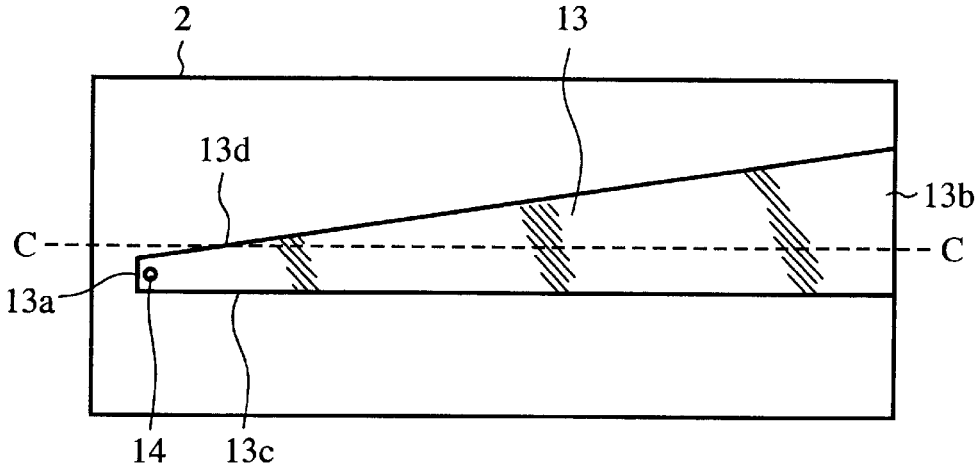
FIG. 3 is a bottom view of the balun according to the first embodiment shown in FIG. 1.
Figure 4:
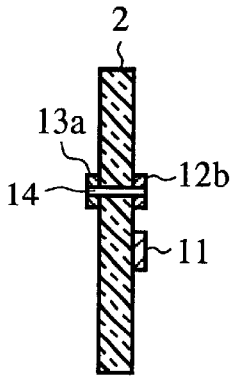
FIG. 4 is a cross-sectional view, taken along the line A—A of FIG. 2, of the balun according to the first embodiment.
Figure 5:
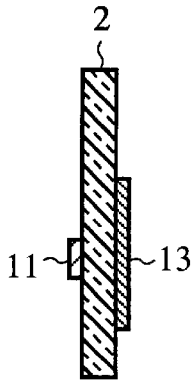
FIG. 5 is a cross-sectional view, taken along the line B—B of FIG. 2, of the balun according to the first embodiment.

FIG. 2 is a plan view of the balun 1 shown in FIG. 1, and FIG. 3 is a bottom view of the balun 1 shown in FIG. 1. Furthermore, FIG. 4 is a cross-sectional view taken along the line A—A of FIG. 2, and FIG. 5 is a cross-sectional view taken along the line B—B of FIG. 2.

As shown in these drawings, the balun 1 is provided with a pair of two parallel wires, i.e., a balanced line that consists of a first end portion 11*a* of the first conductive layer 11 and a first end portion 12*a* of the second conductive layer 12, and a microstrip line, i.e., an unbalanced line that consists of a second end portion 11*b* of the first conductive layer 11 and a second end portion 13*b* of the third conductive layer 13. Furthermore, as shown in FIG. 4, the through hole 14 penetrates through the second end portion 12*b* of the second conductive layer 12, the substrate 2, and the first end portion 13*a* of the third conductive layer 13, and has an inner wall plated with a metallic material. Therefore, the second end portion 12*b* of the second conductive layer 12 is electrically connected to the first end portion 13*a* of the third conductive layer 13 by way of the through hole 14.

As shown in FIGS. 1 and 3, the third conductive layer 13 is tapered from a maximum width at the second end portion 13*b* thereof to a minimum width at the first end portion 13*a* thereof. The taper of the third conductive layer 13 is a linear taper. In the example shown in the drawings, a first side 13*c* of the third conductive layer 13 that is a further one with respect to a center line C of the substrate 2 is formed in parallel with the first conductive strip layer 11, and a second side 13*d* of the third conductive layer 13 that is a nearer one with respect to the center line C is formed so that the distance between itself and the first side 13*c* increases with distance from the first end portion 13*a* of the third conductive layer 13.

The balun 1 transforms the characteristic impedance of the balanced line, i.e., the pair of two parallel wires into the characteristic impedance of the unbalanced line, i.e., the microstrip line. The rate of change of the width of the third conductive layer 13 along the length of the third conductive layer 13 has to be small enough to decrease the amount of reflection to be caused by changes in the characteristic impedance in the balun 1. At a point where the width of the third conductive layer 13 is assumed to be adequately large compared with the width of the first conductive layer 11, and the increase in the width of the third conductive layer 13 gives little influence to the characteristic impedance of the unbalanced line, the balun 1 completely performs the transformation from the balanced line to the unbalanced line (i.e., transformation from balanced mode to unbalanced mode).

The width of the second end portion 11*b* of the first conductive layer 11 that constitutes the unbalanced line is determined so that the unbalanced line has a desired characteristic impedance. If mismatching is caused in the characteristic impedance of the balanced line, it is preferable that the first conductive layer 11 is tapered like the third conductive layer 13.

An unbalanced line that is coupled to the balun 1 generally has a characteristic impedance of about 50 to 75 Ω. Therefore, the width of the second end portion 11*b* of the first conductive layer 11 that constitutes the unbalanced line of the balun is determined so that the unbalanced line has the same characteristic impedance as an unbalanced line coupled to the balun. In this case, if the second end portion 13*b* of the third conductive layer 13 has a width four to five or more times that of the second end portion 11*b* of the first conductive layer 11, the balun 1 completes the transformation from the balanced mode to the unbalance mode. Furthermore, when the unbalanced line coupled to the balun 1 is a coaxial cable, it is preferable that the second end portion 13*b* of the third conductive layer 13 has a width almost equal to the diameter of an outer conductor of the coaxial cable coupled to the second end portion 13*b*. In addition, it is preferable that the third conductive layer 13 has a length equal to or greater than one-half of the wavelength of a microwave to be transmitted via the balun in order to reduce the amount of reflection sufficiently.

Figure 6A:
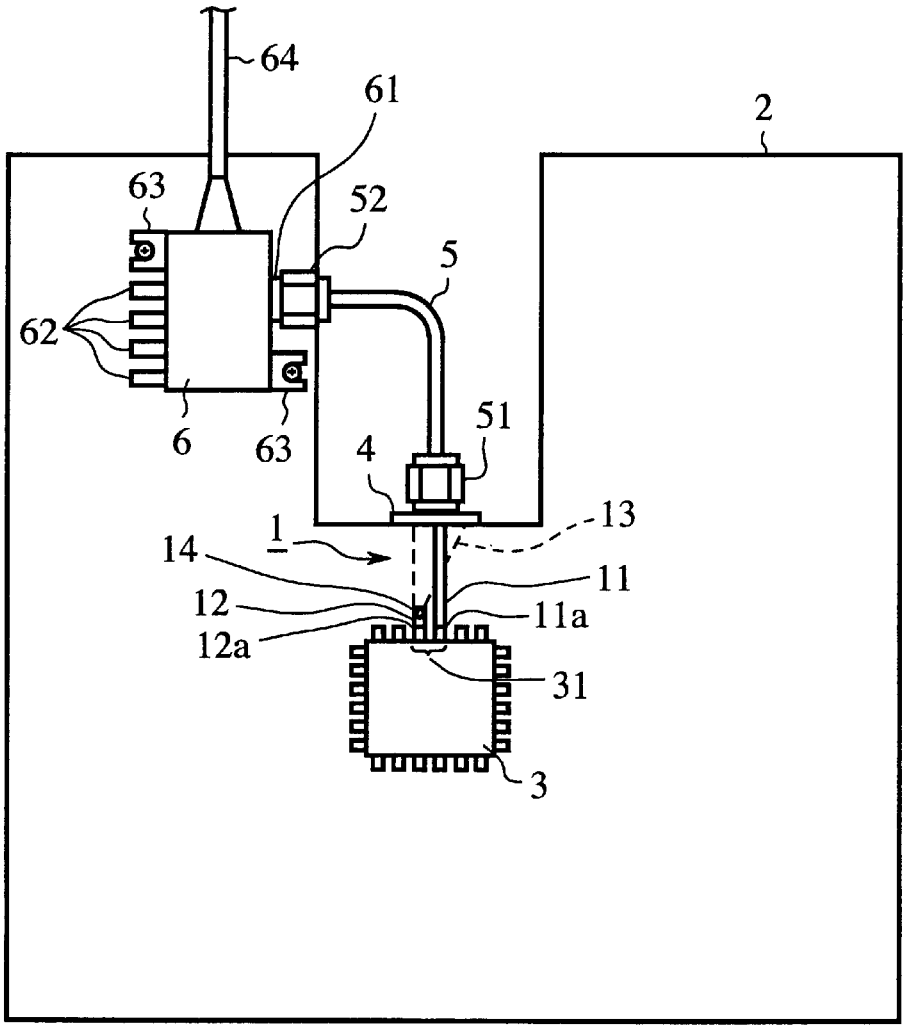
FIG. 6(*a*) is a plan view showing the structure of a semiconductor device according to the first embodiment of the present invention, the device including the balun shown in FIG. 1.
Figure 6B:
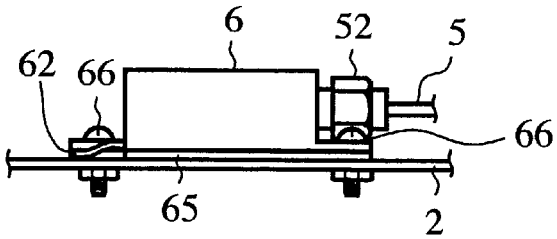

In the following, the operation of the balun 1 of the first embodiment of the present invention will be explained with reference to FIG. 6(*a*) showing the structure of a semiconductor device according to the first embodiment of the present invention, into which the balun 1 is incorporated. In FIG. 6(*a*), reference numeral 3 denotes an IC (electronic circuit) such as a multiplexer intended for optical communications, the IC being mounted on the substrate 2 and having a pair of balanced output terminals (or a pair of balanced input terminals) 31 connected to both the first end portion 11*a* of the first conductive layer 11 of the balun 1 and the first end portion 12*a* of the second conductive layer 12 of the balun 1, respectively, reference numeral 4 denotes a coaxial connector receptacle mounted on the substrate 2 and having a center terminal connected to the second end portion 11*b* of the first conductive layer 11 and an outer terminal connected to the second end portion 13*b* of the third conductive layer 13, reference numeral 5 denotes a coaxial cable having a coaxial connector plug 51 at one end thereof, which is connected to the receptacle 4, and another coaxial connector plug 52 at another end thereof, and reference numeral 6 denotes an optical module (electronic module) having an optical semiconductor component, such as an optical transmitter, an optical modulation module (e.g., EA (electric-field absorption) component), or an LD (laser diode) module, which is driven by a high-frequency signal applied from the IC 3 by way of the balun 1 and the coaxial cable 5, or a PD (photo diode) module for detecting an optical signal received and for generating a high-frequency signal. The optical module 6 is provided with a receptacle 61 connected to the plug 52 of the coaxial cable 5, a plurality of terminals 62, mounting members 63 used for mounting the optical module 6 on the substrate 2, and an optical fiber 64.

FIG. 6(*b*) is a view showing mounting of the optical module 6 on the substrate 2. In the figure, reference numeral 65 denotes an insulation sheet disposed between the optical module 6 and the substrate 2, for electrically insulating a package of the optical module 6 from the substrate 2, and reference numeral 66 denotes a screw made of an insulating material such as a polycarbonate. As shown in FIG. 6(*a*), since the first through third conductive layers 11 to 13, which constitute the balun 1, are formed on the substrate 2 which is a printed board of the semiconductor device, it is necessary to electrically insulate a ground of the optical module 6 associated with a high-frequency signal line, i.e., the package of the optical module 6 from a grounded surface of the substrate 2. To this end, as shown in FIG. 6(*b*), the optical module 6 is-mounted on the substrate 2 with the screws 66 each of which is made of an insulating material so that the insulation sheet 65 formed to cover the bottom surface of the optical module 6 is sandwiched between the optical module 6 and the substrate 2. By way of the plurality of terminals 62, a control signal of a low frequency, a bias signal of a low frequency, etc. are input and output to and from the optical module 6. In general, signal lines for these low-frequency signals are grounded, and the low-frequency signal lines are electrically insulated from high-frequency signal lines in a substrate or the like inside the optical module 6.

Figure 7:
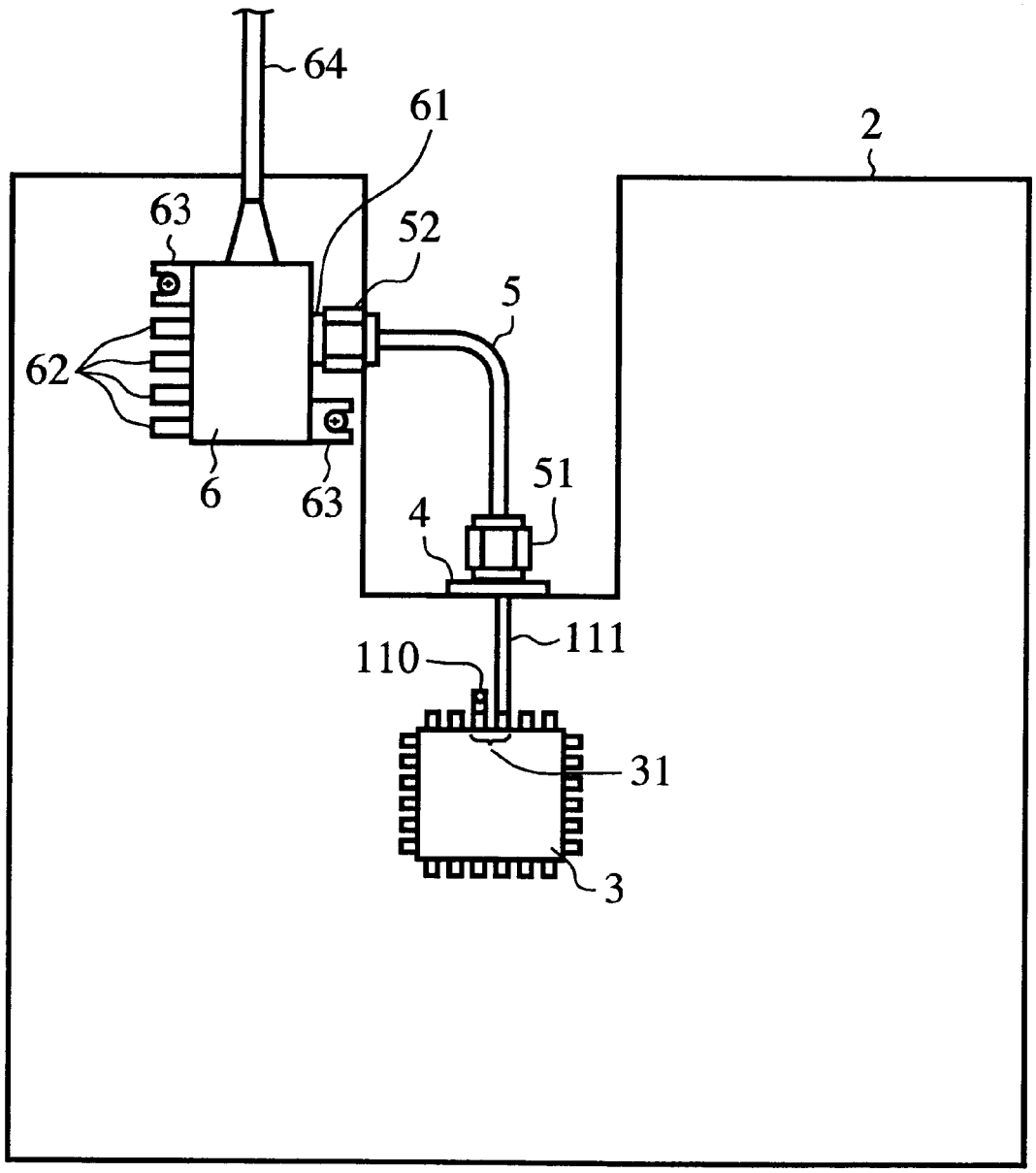
FIG. 7 is a plan view showing a semiconductor device having a microstrip line.

FIG. 7 is a plan view showing a semiconductor device having a microstrip line, which is illustrated for comparison with FIG. 6(*a*). In the figure, the same reference numerals as shown in FIG. 6(*a*) denote the same components as those of FIG. 6(*a*). Furthermore, reference numeral 110 denotes a termination that connects one of a pair of balanced output terminals 31 to a grounded surface of a substrate 2, and reference numeral 111 denotes a microstrip line that connects the other one of the pair of balanced output terminals 31 to a center terminal of a receptacle 4 for use with a coaxial connector, which is mounted on the substrate 2. When an IC 3 generates a pair of balanced outputs 180 degrees out of phase with each other in the semiconductor device constructed as above, one of the balanced outputs is caused to flow to the grounded surface of the substrate 2 by way of the termination 110, and the other one of them is sent to a coaxial cable 5 by way of the microstrip line 111. Therefore, the combination of the termination 110 and the microstrip line 111 transforms the pair of balanced outputs into an unbalance signal and then supplies it to an optical module 6 by way of the coaxial cable 5.

In the first embodiment, the IC 3 is adapted to output a signal to the balun 1 in balanced mode resistant to noise (i.e., in which noise is counterbalanced) by way of the pair of balanced output terminals 31, for example. As previously mentioned, the balun 1 connects a balanced line to an unbalanced line, and also transforms the characteristic impedance of the balanced line into the characteristic impedance of the unbalanced line. As a result, a signal in unbalanced mode can be output from the balun 1, and can be then input to the optical module 6 by way of the coaxial cable 5. The optical module 6 is driven by the signal in the unbalanced mode applied thereto. For example, to drive the optical module 6, the IC3 outputs two equal-amplitude signals CNT and *CNT which are 180 degrees out of phase with each other. In this case, the optical module 6 is driven by the difference between these signals CNT and *CNT. Therefore, the semiconductor device according to the first embodiment of the present invention, as shown in FIG. 6(*a*), can drive the optical module 6 with efficiency by using the two signals CNT and *CNT, unlike a semiconductor device provided with a microstrip line as shown in FIG. 7. In addition, since the semiconductor device of the first embodiment uses both of the two signals CNT and *CNT, it is possible to prevent the load on the IC 3 from becoming unbalanced, thereby preventing the operating status of the IC 3 from becoming unstable.

As previously mentioned, the optical module 6 can be a 40 Gbps optical transmitter which is a key component for implementing a 40 Gbps optical fiber communication system, an optical modulation module (e.g., an EA (electric-field absorption) component) that performs amplitude modulation or phase modulation on light incident thereon, an LD (laser diode) module, or the like. In this case, the IC 3 can be a multiplexer, a modulation driver, an LD driver, or the like. As an alternative, the optical module 6 can be a 40 Gbps optical receiver that transmits a high-frequency signal to the IC 3 by way of the balun 1, a PD (photo diode) module, or the like. In this case, the IC3 can be a demultiplexer, a PD preamplifier, or the like.

As mentioned above, in accordance with the first embodiment of the present invention, the balun 1 comprises a third conductive layer 13 disposed on a bottom surface of a substrate 2, the third conductive layer having a first end portion 13*a* electrically connected to a second end portion 12*b* of a second conductive layer 12 disposed on a top surface of the substrate 2 via a through hole 14 penetrating through the substrate 2, and a second end portion 13*b* that serves as an unbalanced transmission line in cooperation with a second end portion 11*b* of a first conductive layer 11 disposed on the top surface of the substrate 2 in parallel with the second conductive layer 12, the third conductive layer 13 being tapered from a maximum width at the second end portion 13*b* thereof to a minimum width at the first end portion 13*a* thereof, the balun can transform balanced mode into unbalanced mode over a wide frequency range. The balun can also facilitate the connection of-itself with an IC 3 having a pair of balanced output terminals in the same plane with an optical module 6. Furthermore, although a balun constructed as shown in FIG. 7 can transform balanced mode into unbalanced mode, the balun according to the first embodiment of the present invention makes it possible to effectively use outputs from the pair of balanced output terminals of the IC 3 without connecting one of the pair of balanced output terminals to the grounded surface of the substrate 2 by way of a termination, thereby preventing the operating status of the IC 3 from becoming unstable, and improving the efficiency of the semiconductor device including the IC 3 and the optical module 6.

Embodiment 2

Figure 8:
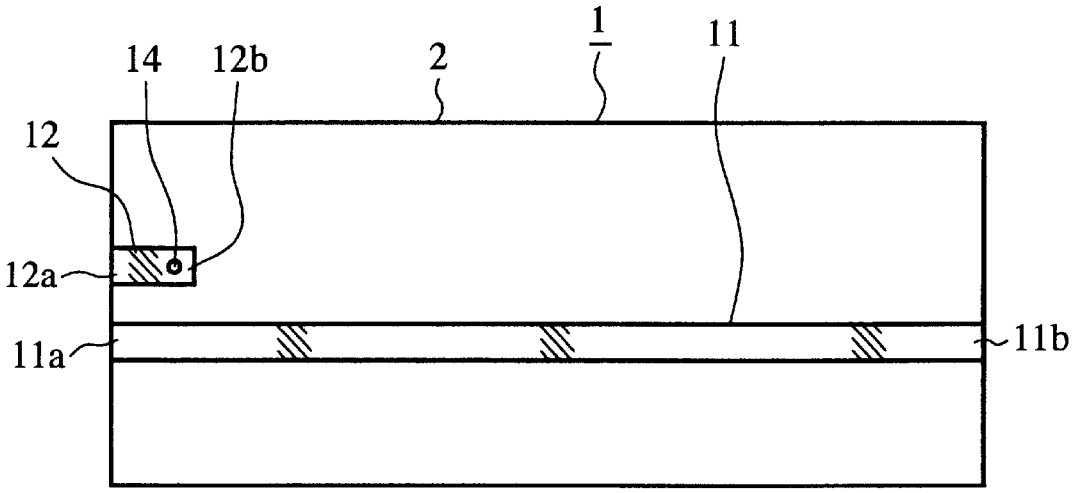
FIG. 8 is a plan view showing the structure of a balun according to a second embodiment of the present invention.
Figure 9:
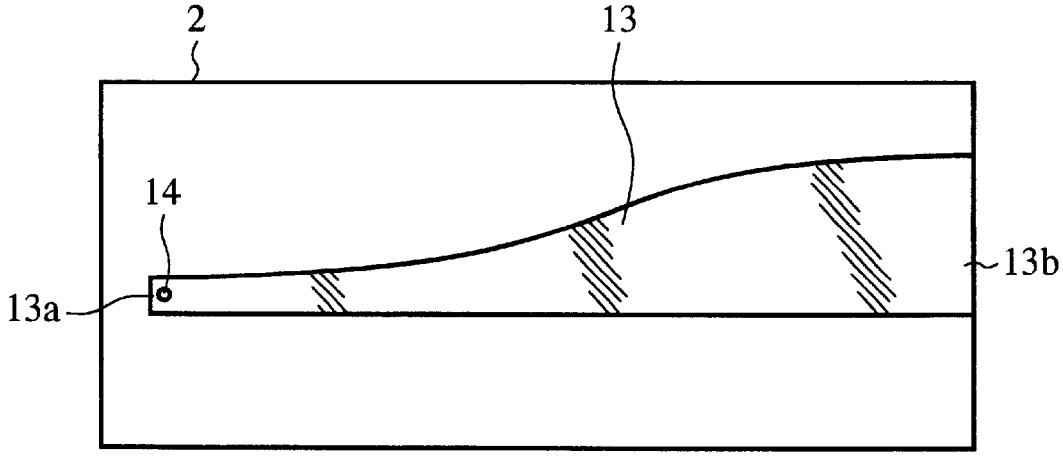
FIG. 9 is a bottom view of the balun according to the second embodiment shown in FIG. 8.

FIG. 8 is a plan view showing the structure of a balun according to a second embodiment of the present invention, and FIG. 9 is a bottom view of the balun shown in FIG. 8. The same reference numerals as shown in FIGS. 2 and 3 denote the same components as those of the balun according to the above-mentioned first embodiment or like components, and therefore the explanation of those components will be omitted hereafter.

As previously mentioned, the taper of a third conductive layer 13 can be optimized so as to minimize the amount of reflection due to changes in the characteristic impedance of the balun. The taper of the third conductive layer 13 can be, as to shifting characteristic impedance, an exponential taper, a triangular taper, a curved taper such as a Klopfenstein taper, or any other taper which can reduce the amount of reflection while transforming the characteristic impedance of a balanced line into the characteristic impedance of an unbalanced line over a large frequency band, other than a linear taper. The taper of the third conductive layer 13 can be any of an infinite number of possible ones but it is said that a Klopfenstein taper is one of the best tapers in general. This is because a Klopfenstein taper has a minimum reflection coefficient provided that the tapered line has an identical length (which corresponds to the length of the third conductive layer 13 in the example shown in FIG. 9), and has the shortest length provided that the tapered line has an identical reflection coefficient.

Since the balun 1 according to the second embodiment of the present invention operates in the same way that the balun according to the above-mentioned first embodiment does, the explanation of the operation of the balun 1 will be omitted hereafter.

As mentioned above, in accordance with the second embodiment of the present invention, since the balun 1 has a third conductive layer 13 whose taper is optimized to minimize the amount of reflection due to changes in the characteristic impedance of the balun, the balun can perform the balanced-to-unbalanced transformation over a larger frequency band when it has the same length as the balun according to the above-mentioned first embodiment. In addition, the balun 1 of the second embodiment can be further downsized when the same amount of reflection as that provided by the balun according to the above-mentioned first embodiment is acceptable.

Embodiment 3

Figure 10:
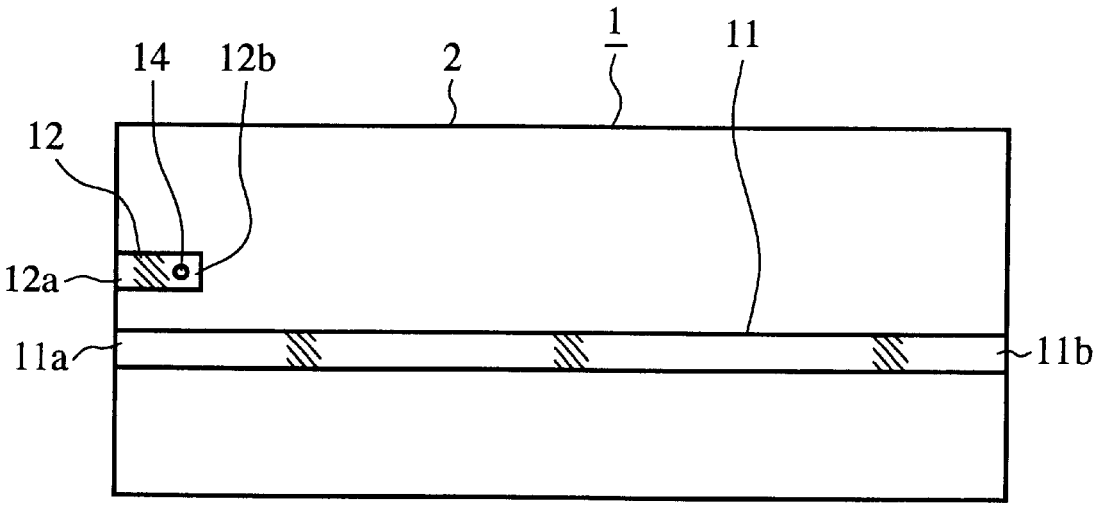
FIG. 10 is a plan view showing the structure of a balun according to a third embodiment of the present invention.
Figure 11:
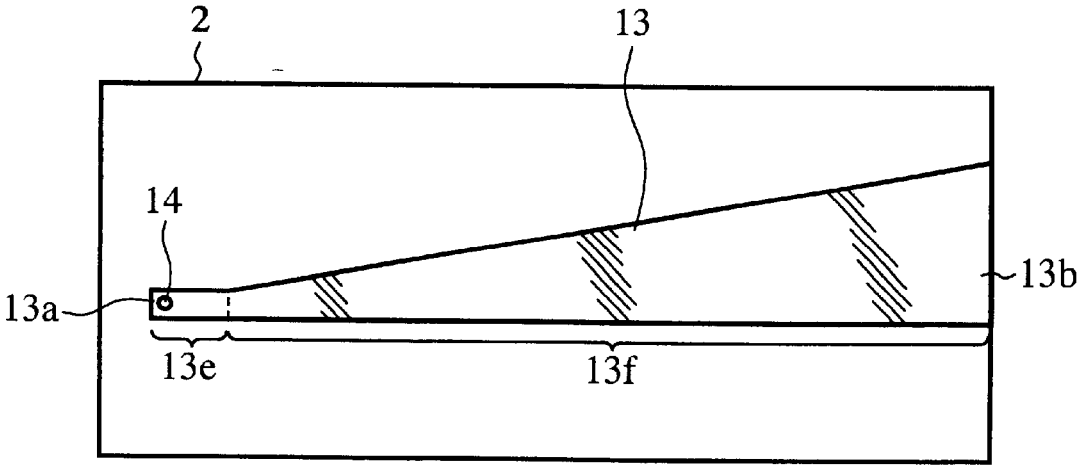
FIG. 11 is a bottom view of the balun according to the third embodiment shown in FIG. 10.

FIG. 10 is a plan view showing the structure of a balun according to a third embodiment of the present invention, and FIG. 11 is a bottom view of the balun shown in FIG. 10. The same reference numerals as shown in FIGS. 2 and 3 denote the same components as those of the balun according to the above-mentioned first embodiment or like components, and therefore the explanation of those components will be omitted hereafter. In FIGS. 10 and 11, reference numeral 13*e* denotes a first segment formed in the form of a strip and including a first end portion 13*a* of a third conductive layer 13 disposed on a bottom surface of a substrate 2, the first end portion 13*a* of the third conductive layer 13 being electrically connected to a second end portion 12*b* of a second conductive layer 12 via a through hole 14 penetrating through the substrate 2, and reference numeral 13*f* denotes a second segment of the third conductive layer 13, which is linearly-tapered. The first end portion 13*a* of the first segment 13*e* has a width smaller than that of the second end portion 12*b* of the second conductive layer 12.

In the above-mentioned first embodiment, when a comparison is made between the capacitance between the first and second conductive layers 11 and 12, which occurs before the connection of the second conductive layer 12 with the third conductive layer 13 via the through hole 14, and the capacitance between the first and third conductive layers 11 and 13, which occurs after the connection of the second conductive layer 12 with the third conductive layer 13 via the through hole 14, it is determined that the characteristic impedance decreases slightly before and after the connection of the second conductive layer 12 with the third conductive layer 13 via the through hole 14 because the capacitance between the first and third conductive layers 11 and 13 is larger than the capacitance between the first and second conductive layers 11 and 12. Therefore, the amount of reflection at the connection point between the second conductive layer 12 and the third conductive layer 13 via the through hole 14 increases.

In contrast, since the third conductive layer 13 of the balun 1 according to the third embodiment includes the first strip segment 13*e* that contains the first end portion 13*a* having a width smaller than that of the second end portion 12*b* of the second conductive layer 12, the capacitance between the first and third conductive layers 11 and 13 that occurs immediately after the through hole 14 becomes small, and the first segment 13*e* has a larger inductance compared with a corresponding part of the third conductive layer 13 according to the above-mentioned first embodiment. As a result, the characteristic impedance can be made larger, and therefore the amount of reflection at the connection point between the second conductive layer 12 and the third conductive layer 13 via the through hole 14 can be reduced.

Since the balun 1 according to the third embodiment operates in the same way that the balun according to the above-mentioned first embodiment does, the explanation of the operation of the balun 1 will be omitted hereafter.

The taper of the second segment 13*f* is not limited to a linear taper. The taper of the second segment 13*f* can be, as to shifting characteristic impedance, an exponential taper, a triangular taper, a curved taper such as a Klopfenstein taper, or any other taper which can reduce the amount of reflection while transforming the characteristic impedance of the balanced line into the characteristic impedance of the unbalanced line over a large frequency band.

As mentioned above, in accordance with the third embodiment of the present invention, since the balun 1 is provided with a third conductive layer 13 having a first segment 13*e* that is formed in the form of a strip and contains a first end portion 13*a* having a width smaller than that of a second end portion 12*b* of a second conductive layer 12, the amount of reflection at the connection point between the second conductive layer 12 and the third conductive layer 13 via a through hole 14 can be reduced.

Embodiment 4

Figure 12:
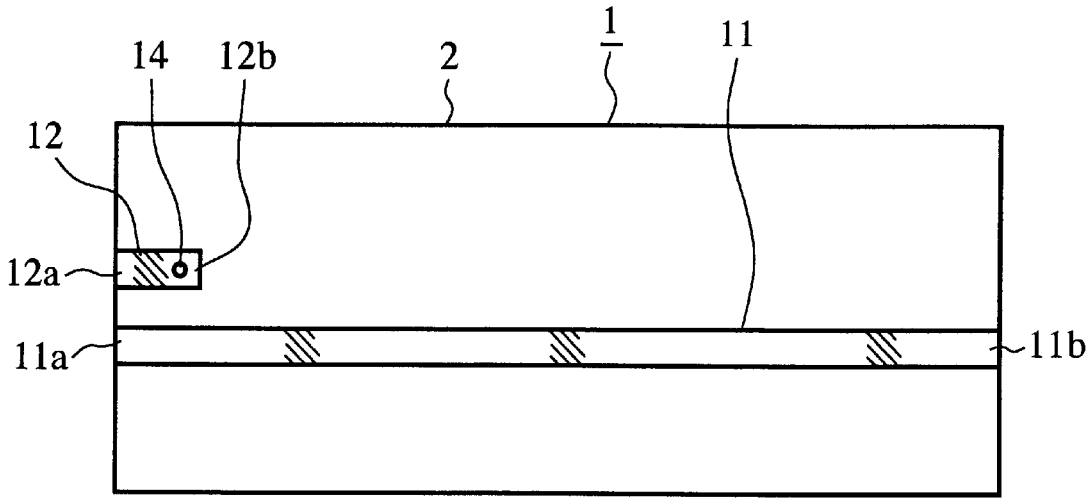
FIG. 12 is a plan view showing the structure of a balun according to a fourth embodiment of the present invention.
Figure 13:
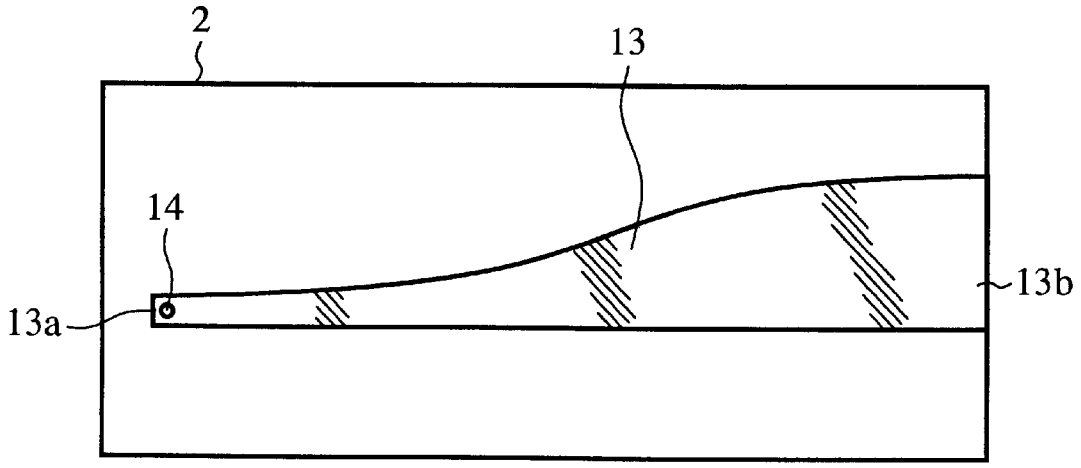
FIG. 13 is a bottom view of the balun according to the fourth embodiment shown in FIG. 12.

FIG. 12 is a plan view showing the structure of a balun according to a fourth embodiment of the present invention, and FIG. 13 is a bottom view of the balun shown in FIG. 12. The same reference numerals as shown in FIGS. 8 and 9 denote the same components as those of the balun according to the above-mentioned second embodiment or like components, and therefore the explanation of those components will be omitted hereafter.

The taper of a third conductive layer 13 according to the fourth embodiment can be optimized so as to minimize the amount of reflection due to changes in the characteristic impedance of the balun 1, as in the case of the above-mentioned second embodiment. In other words, the taper of the third conductive layer 13 can be, as to shifting characteristic impedance, an exponential taper, a triangular taper, a curved taper such as a Klopfenstein taper, or any other taper which can reduce the amount of reflection while transforming the characteristic impedance of a balanced line into the characteristic impedance of an unbalanced line over a large frequency band, other than a linear taper.

The balun 1 according to the fourth embodiment differs from that according to the above-mentioned second embodiment in that a first end portion 13*a* of the third conductive layer 13 has a width smaller than that of a second end portion 12*b* of a second conductive layer 12.

As previously mentioned, when a comparison is made between the capacitance between a first conductive layer 11 and the second conductive layer 12 that occurs before the connection of the second conductive layer 12 with the third conductive layer 13 via a through hole 14, and the capacitance between the first and third conductive layers 11 and 13 that occurs after the connection of the second conductive layer 12 with the third conductive layer 13 via the through hole 14, it is determined that the characteristic impedance decreases slightly before and after the connection of the second conductive layer 12 with the third conductive layer 13 via the through hole 14 because the capacitance between the first and third conductive layers 11 and 13 is larger than the capacitance between the first and second conductive layers 11 and 12. Therefore, the amount of reflection at the connection point between the second conductive layer 12 and the third conductive layer 13 via the through hole 14 increases. In contrast, since the first end portion 13*a* of the third conductive layer 13 of the balun 1 according to the fourth embodiment has a width smaller than that of the second end portion 12*b* of the second conductive layer 12, the capacitance between the first and third conductive layers 11 and 13 that occurs immediately after the through hole 14 becomes small, and the first end portion 13*a* of the third conductive layer 13 has a larger inductance compared with that of the third conductive layer 13 according to the above-mentioned second embodiment. As a result, the characteristic impedance can be made larger, and therefore the amount of reflection at the connection point between the second conductive layer 12 and the third conductive layer 13 via the through hole 14 can be reduced.

Since the balun 1 according to the fourth embodiment operates in the same way that the balun according to the above-mentioned first embodiment does, the explanation of the operation of the balun 1 will be omitted hereafter.

Alternatively, the taper of the third conductive layer 13 can be a linear taper. In this case, the third conductive layer 13 is equivalent to the one of the above-mentioned third embodiment in which the first segment 13*e* has a length of 0.

As mentioned above, in accordance to the fourth embodiment of the present invention, since the balun 1 is provided with a third conductive layer 13 that is tapered and contains a first end portion 13*a* having a width smaller than that of a second end portion 12*b* of a second conductive layer 12, the amount of reflection at the connection point between the second conductive layer 12 and the third conductive layer 13 via a through hole 14 can be reduced.

Embodiment 5

Figure 14:
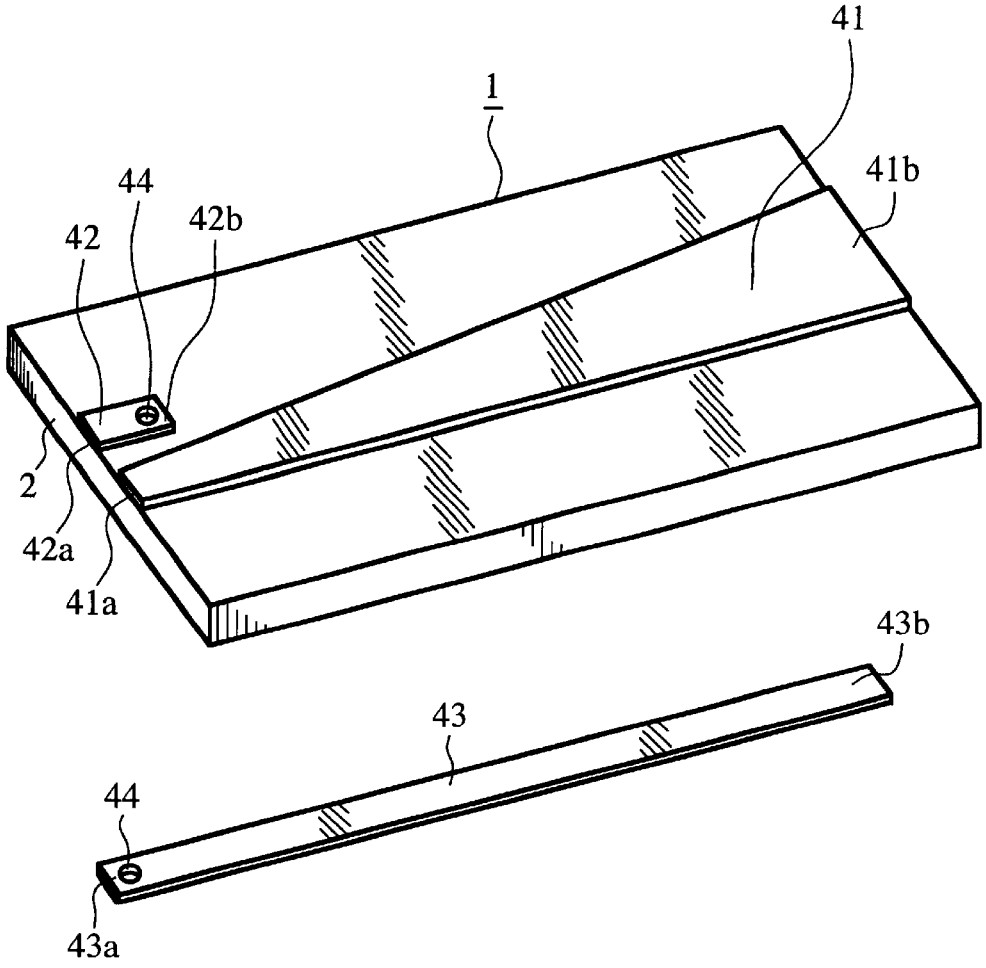
FIG. 14 is a perspective view showing the structure of a balun according to a fifth embodiment of the present invention.
Figure 15:
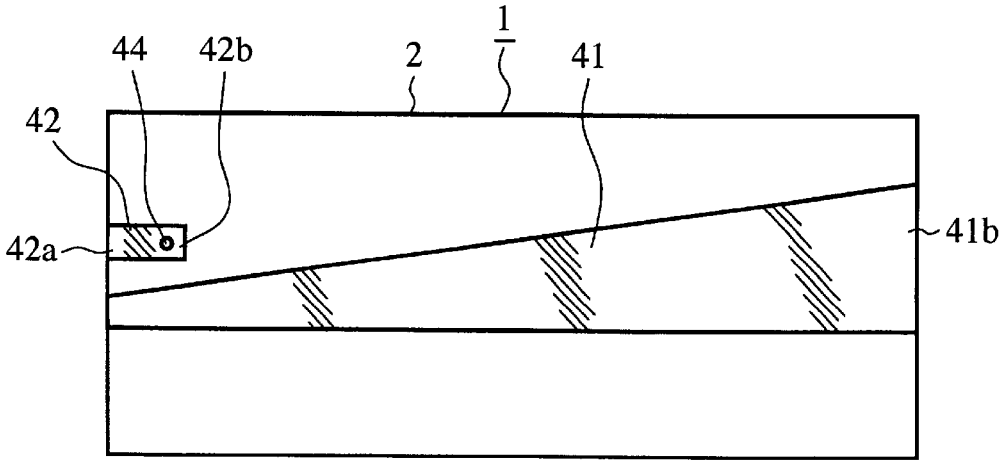
FIG. 15 is a plan view of the balun according to the fifth embodiment shown in FIG. 14.
Figure 16:
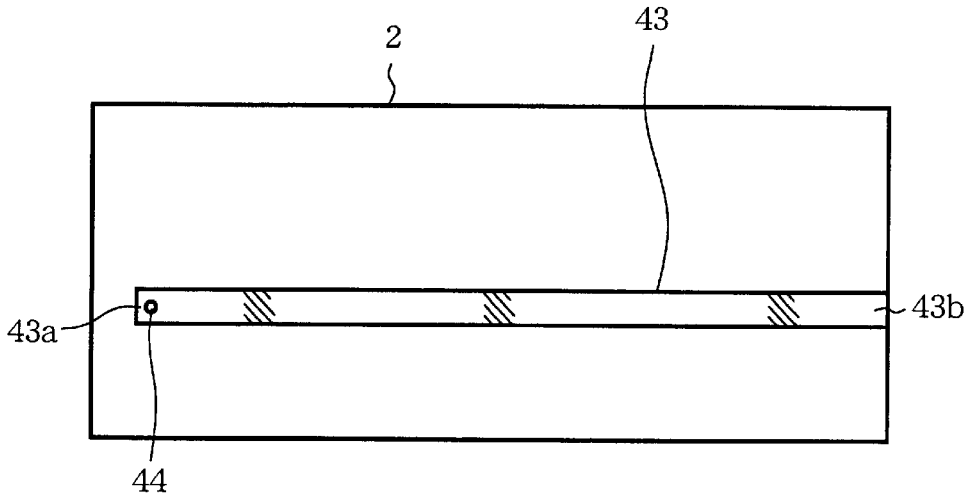
FIG. 16 is a bottom view of the balun according to the fifth embodiment shown in FIG. 14.

FIG. 14 is a perspective view showing the structure of a balun according to a fifth embodiment of the present invention. FIG. 15 is a plan view of the balun shown in FIG. 14, and FIG. 16 is a bottom view of the balun shown in FIG. 14. In these figures, the same reference numerals as shown in FIGS. 1 to 3 denote the same components as those of the balun according to the above-mentioned first embodiment or like components, and therefore the explanation of those components will be omitted hereafter. In FIGS. 14 to 16, reference numeral 41 denotes a first conductive layer that is tapered and is disposed on a top surface of a substrate 2, reference numeral 42 denotes a second conductive layer that is formed in the form of a strip and is disposed on the top surface of the substrate 2, the second conductive layer 42 having a shorter length than the first conductive layer 41, and reference numeral 43 denotes a third conductive layer that is disposed on a bottom surface of the substrate 2, and is electrically connected to the second conductive layer 42 via a through hole 44 penetrating the substrate 2.

As shown in these drawings, the balun 1 is provided with a pair of two parallel wires, i.e., a balanced line that consists of a first end portion 41*a* of the first conductive layer 41 and a first end portion 42*a* of the second conductive layer 42, and a microstrip line, i.e., an unbalanced line that consists of a second end portion 41*b* of the first conductive layer 41 and a second end portion 43*b* of the third conductive layer 43. Furthermore, the through hole 44 penetrates through the second end portion 42*b* of the second conductive layer 42, the substrate 2, and the first end portion 43*a* of the third conductive layer 43, and has an inner wall plated with a metallic material. Therefore, the second end portion 42*b* of the second conductive layer 42 is electrically connected to the first end portion 43*a* of the third conductive layer 43 by way of the through hole 44.

As shown in FIGS. 14 and 15, the first conductive layer 41 is tapered from a maximum width at the second end portion 41*b* thereof to a minimum width at the first end portion 41*a* thereof. The taper of the first conductive layer 41 is a linear taper. Like the balun according to either of the first through fourth embodiments, the balun 1 of the fifth embodiment transforms the characteristic impedance of the balanced line, i.e., the pair of two parallel wires into the characteristic impedance of the unbalanced line, i.e., the microstrip line. The rate of change of the width of the first conductive layer 41 along the length of the first conductive layer 41 has to be small enough to decrease the amount of reflection to be caused by changes in the characteristic impedance in the balun 1, as in the case of the third conductive layer of the balun according to the above-mentioned first embodiment or other embodiment. At a point where the width of the first conductive layer 41 is assumed to be adequately large compared with the width of the third conductive layer 43, and the increase in the width of the first conductive layer 41 gives little influence to the characteristic impedance of the unbalanced line, the balun 1 completely performs the transformation from the balanced line to the unbalanced line (i.e., transformation from balanced mode to unbalanced mode).

Since the balun 1 according to the fifth embodiment operates in the same way that the balun according to the above-mentioned first embodiment does, the explanation of the operation of the balun 1 will be omitted hereafter.

The taper of the first conductive layer 41 of the balun 1 according to the fifth embodiment is not limited to a linear one, and can be optimized so as to minimize the amount of reflection due to changes in the characteristic impedance of the balun 1. In other words, the taper of the first conductive layer 41 can be, as to shifting characteristic impedance, an exponential taper, a triangular taper, a curved taper such as a Klopfenstein taper, or any other taper which can reduce the amount of reflection while transforming the characteristic impedance of a balanced line into the characteristic impedance of an unbalanced line over a large frequency band, other than a linear taper.

As mentioned above, in accordance with the fifth embodiment of the present invention, since the balun 1 comprises a first conductive layer 41 disposed on a top surface of a substrate 2, the first conductive layer 41 being tapered from a maximum width at a second end portion 41*b* thereof to a minimum width at a first end portion 41*a* thereof, and a third conductive layer 43 disposed on a bottom surface of the substrate 2, the third conductive layer having a first end portion 43*a* electrically connected to a second end portion 42*b* of a second conductive layer 42 disposed on the top surface of the substrate 2 together with the first conductive layer 41 via a through hole 44 penetrating through the substrate 2, and a second end portion 43*b* that serves as an unbalanced transmission line in cooperation with the second end portion 41*b* of the first conductive layer 41, the balun can transform balanced mode into unbalanced mode over a wide frequency range. The balun can also facilitate the connection of itself with an electronic circuit, such as an IC, having a pair of balanced output terminals in the same plane. Furthermore, the balun makes it possible to effectively use outputs from the pair of balanced output terminals of the electronic circuit without connecting one terminal of the pair of balanced output terminals to a grounded surface of the substrate 2 by way of a termination, thereby preventing the operating status of the electronic circuit from becoming unstable, and improving the efficiency of a semiconductor device including the electronic circuit and an optical module including an optical semiconductor component that is driven by the electronic circuit or that outputs a high-frequency signal to the electronic circuit.

Embodiment 6

Figure 17:
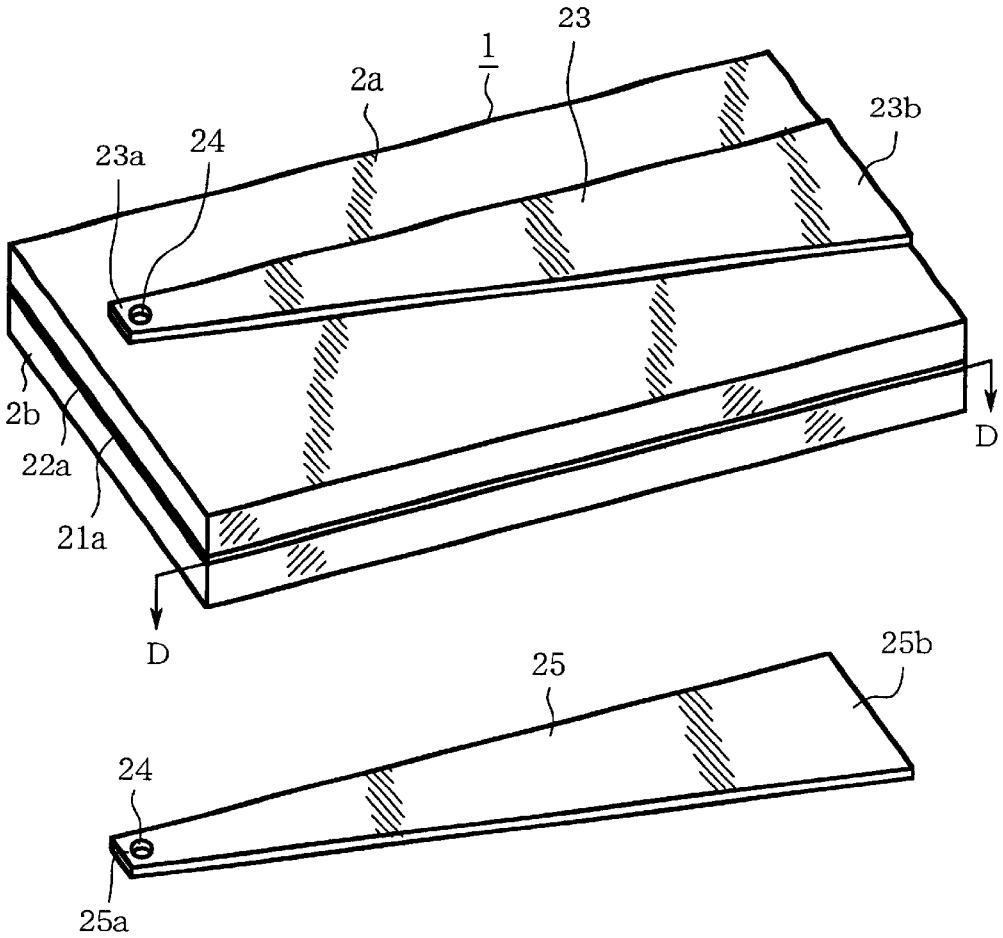
FIG. 17 is a perspective view showing the structure of a balun having a triplate structure according to a sixth embodiment of the present invention.
Figure 18:
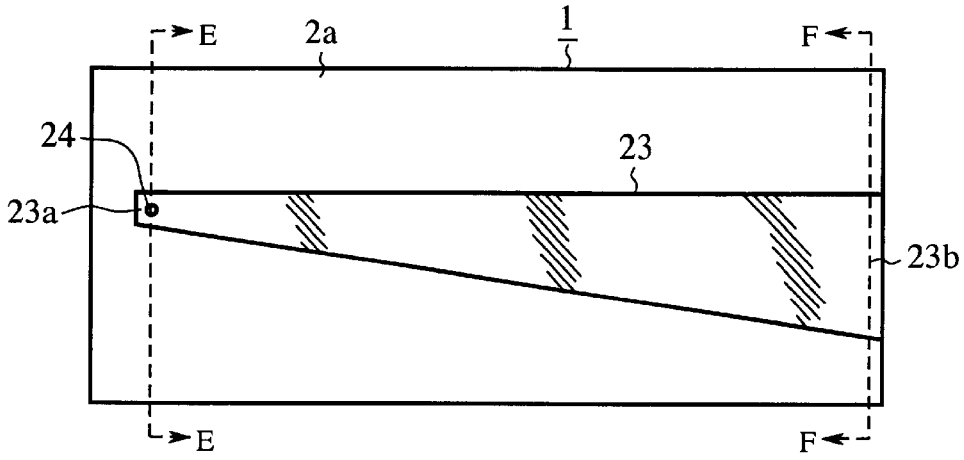
FIG. 18 is a plan view of the balun according to the sixth embodiment shown in FIG. 17.
Figure 19:
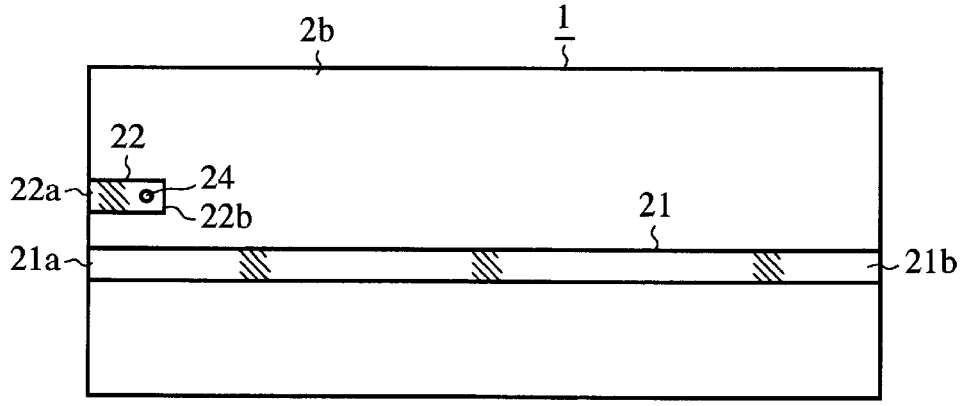
FIG. 19 is a plan view, taken along the line D—D of FIG. 16, of the balun according to the sixth embodiment.
Figure 20:
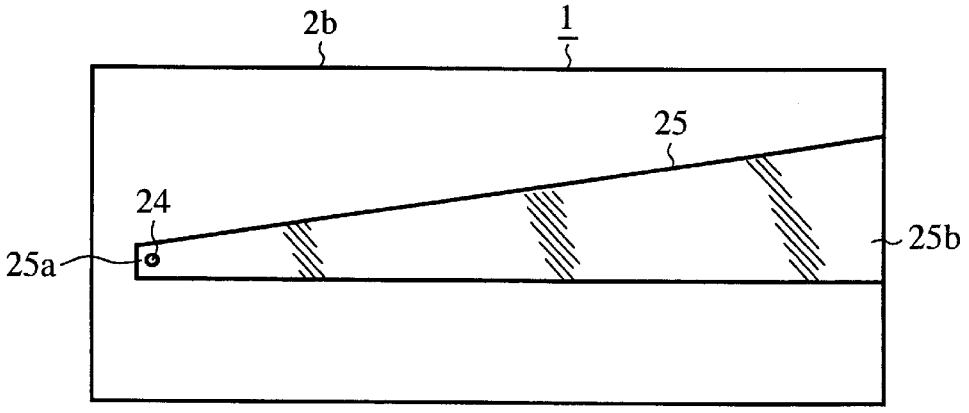
FIG. 20 is a bottom view of the balun according to the sixth embodiment shown in FIG. 17.
Figure 21:
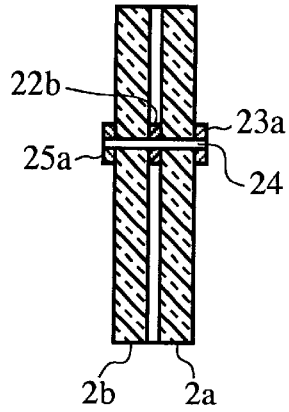
FIG. 21 is a cross-sectional view, taken along the line E—E of FIG. 18, of the balun according to the sixth embodiment.
Figure 22:
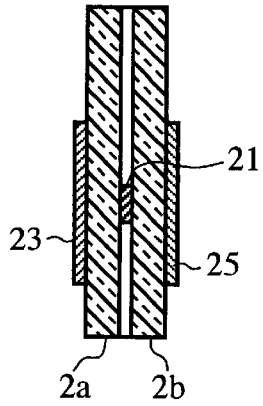
FIG. 22 is a cross-sectional view, taken along the line F—F of FIG. 18, of the balun according to the sixth embodiment.
Figure 23:
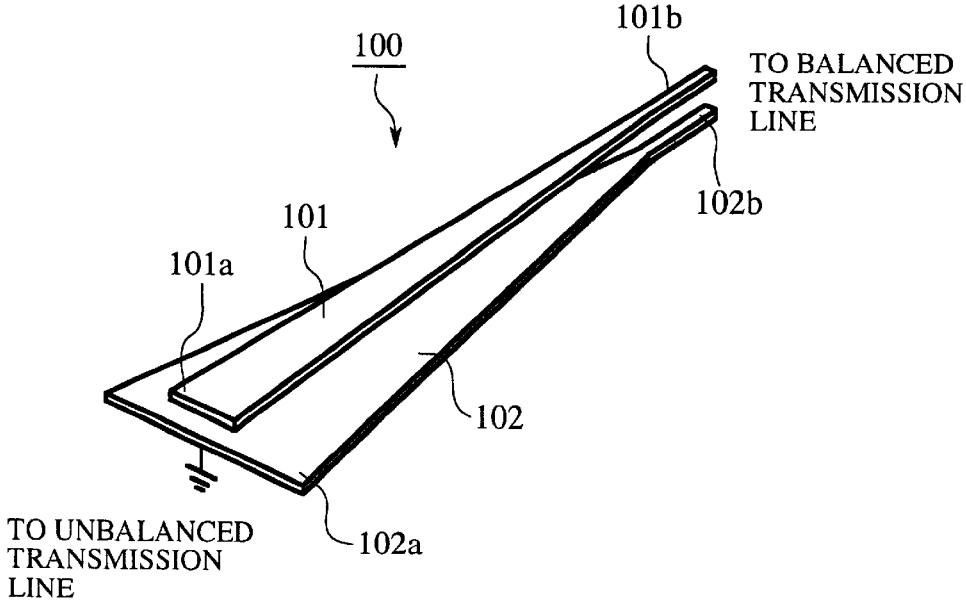
FIG.23 (PRIOR ART)
FIG. 23 is a perspective view showing the structure of a prior art balun which is in practical use and operates in a microwave band, the balun having small wavelength dependence and a large frequency band.
Figure 24:
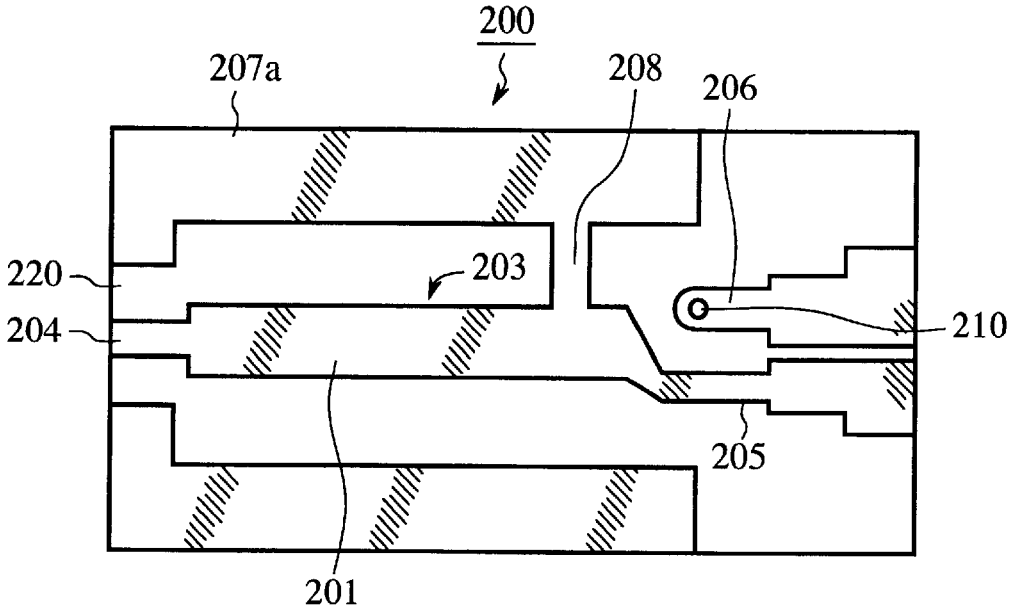
FIG.24 (PRIOR ART)
FIG. 24 is a plan view showing the structure of a prior art balun which is incorporated into power amplifiers for use with television broadcasting transmitters.
Figure 25:
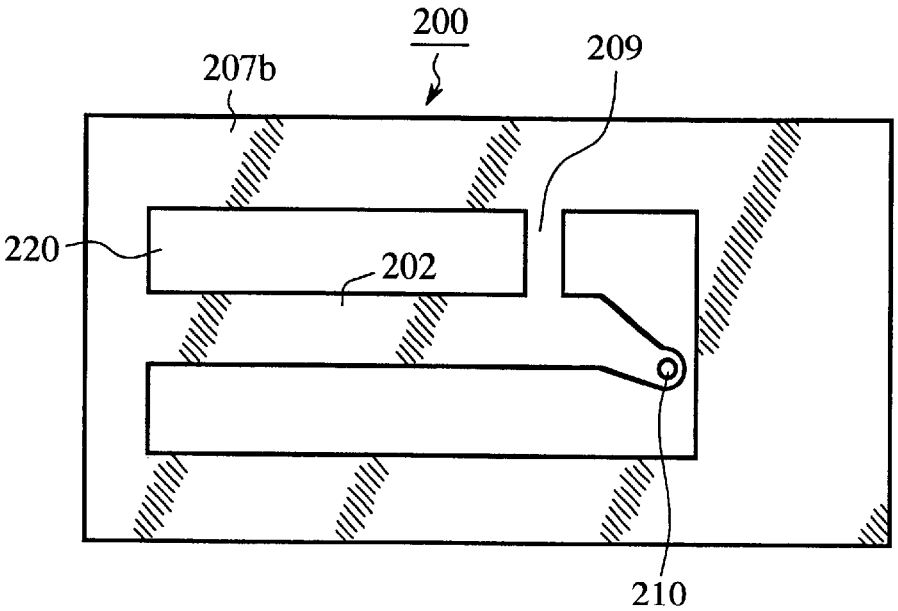
FIG.25 (PRIOR ART)
FIG. 25 is a bottom view of the prior art balun shown in FIG. 24.

FIG. 17 is a perspective view showing the structure of a balun having a triplate structure according to a sixth embodiment of the present invention. FIG. 18 is a plan view of the balun 1 shown in FIG. 17. FIG. 19 is a plan view taken along the line D—D of the balun 1 shown in FIG. 17, and FIG. 20 is a bottom view of the balun 1 shown in FIG. 17. Furthermore, FIG. 21 is a cross-sectional view taken along the line E—E of FIG. 18, and FIG. 22 is a cross-sectional view taken along the line F—F of FIG. 18.

In these drawings, reference numeral 2*a* denotes a first dielectric substrate (abbreviated as first substrate from here on) such as a printed board, reference numeral 2*b* denotes a second dielectric substrate (abbreviated as second substrate from here on) such as a printed board, reference numeral 21 denotes a first conductive layer that is formed in the form of a strip and is disposed between the first and second substrates 2*a* and 2*b* which are laminated, reference numeral 22 denotes a second conductive layer that is formed in the form of a strip and is disposed between the laminated first and second substrates 2*a* and 2*b* in parallel with the first conductive layer 21, the second conductive layer 22 having a shorter length than the first conductive layer 21, reference numeral 23 denotes a third conductive layer that is tapered and is disposed on a top surface of the laminated first and second substrates 2*a* and 2*b* and that is electrically connected to the second conductive layer 22 via a through hole 24 penetrating the laminated first and second substrates 2*a* and 2*b*, and reference numeral 25 denotes a fourth conductive layer that is tapered and is disposed on a bottom surface of the laminated first and second substrates 2*a* and 2*b* and that is electrically connected to the second conductive layer 22 via the through hole 24.

As shown in these drawings, the balun 1 is provided with a pair of two parallel wires, i.e., a balanced line that consists of a first end portion 21*a* of the first conductive layer 21 and a first end portion 22*a* of the second conductive layer 22, and a microstrip line, i.e., an unbalanced line that consists of a second end portion 21*b* of the first conductive layer 21, a second end portion 23*b* of the third conductive layer 23, and a second end portion 25*b* of the fourth conductive layer 25. Furthermore, as shown in FIG. 21, the through hole 24 penetrates through the first end portion 23*a* of the third conductive layer 23, the first substrate 2*a*, the second end portion 22*b* of the second conductive layer 22, the second substrate 2*b*, and the first end portion 25*a* of the fourth conductive layer 25, and has an inner wall plated with a metallic material. Therefore, the second end portion 22*b* of the second conductive layer 22 is electrically connected to the first end portions 23*a* and 25*a* of the third and fourth conductive layers 23 and 25 by way of the through hole 24.

As shown in FIGS. 17 and 18, the third conductive layer 23 is tapered from a maximum width at the second end portion 23*b* thereof to a minimum width at the first end portion 23*a* thereof. The taper of the third conductive layer 23 is a linear one. Similarly, as shown in FIGS. 17 and 20, the fourth conductive layer 25 is tapered from a maximum width at the second end portion 25*b* thereof to a minimum width at the first end portion 25*a* thereof. The taper of the fourth conductive layer 25 is a linear one as well.

The balun 1 according to the sixth embodiment connects a pair of two parallel wires which is a balanced line to an unbalance triplate line while transforming the characteristic impedance of the balanced line into the characteristic impedance of the unbalanced triplate line, i.e., the microstrip line. The rate of change in the widths of the third and fourth conductive layers 23 and 25 along the lengths of the third and fourth conductive layers 23 and 25 has to be small enough to decrease the amount of reflection to be caused by changes in the characteristic impedance of the balun 1, as in the case of the first embodiment. At a point where the width of each of the third and fourth conductive layers 23 and 25 is assumed to be adequately large compared with the width of the first conductive layer 21, and the increase in the width of each of the third and fourth conductive layers 23 and 25 gives little influence to the characteristic impedance of the unbalanced line, the balun 1 completely performs the transformation from the balanced line to the unbalanced line (i.e., transformation from balanced mode to unbalanced mode).

The width of the second end portion 21*b* of the first conductive layer 21 that constitutes the unbalanced line is determined so that the unbalanced line has a desired characteristic impedance. If mismatching is caused in the characteristic impedance of the balanced line, it is preferable that the first conductive layer 21 is tapered like the third and fourth conductive layers 23 and 25.

An unbalanced line that is coupled to the balun 1 generally has a characteristic impedance of about 50 to 75 Ω. Therefore, the width of the second end portion 21*b* of the first conductive layer 21 that constitutes the unbalanced line of the balun is determined so that the unbalanced line has the same characteristic impedance as an unbalanced line coupled to the balun. In this case, if each of the second end portions 23*b* and 25*b* of the third and fourth conductive layers 23 and 25 has a width four to five or more times that of the second end portion 21*b* of the first conductive layer 21, the balun 1 completes the transformation from balanced mode to unbalance mode. In addition, it is preferable that each of the third and fourth conductive layers 23 and 25 has a length equal to or greater than one-half of the wavelength of a microwave to be transmitted via the balun in order to reduce the amount of reflection sufficiently.

Since the balun 1 having a triplate structure according to the sixth embodiment of the present invention operates in the same way that the balun according to the above-mentioned first embodiment does, the explanation of the operation of the balun of the sixth embodiment will be omitted hereafter.

As mentioned above, in accordance with the sixth embodiment of the present invention, since the balun 1 has a triplate structure, and includes a third conductive layer 23 disposed on a top surface of laminated first and second substrates 2*a* and 2*b*, the third conductive layer having a first end portion 23*a* electrically connected to a second end portion 22*b* of a second conductive layer 22 via a through hole 24 penetrating the first and second substrates 2*a* and 2*b*, and a second end portion 23*b* that serves as an unbalanced triplate transmission line in cooperation with a second end portion 21*b* of a first conductive layer 21, the third conductive layer 23 being tapered from a maximum width at the second end portion 23*b* thereof to a minimum width at the first end portion 23*a* thereof, and a fourth conductive layer 25 disposed on a bottom surface of the laminated first and second substrates 2*a* and 2*b*, the fourth conductive layer having a first end portion 25*a* electrically connected to the second end portion 22*b* of the second conductive layer 22 via the through hole 24, and a second end portion 25*b* that serves as the unbalanced triplate transmission line in cooperation with the second end portion 21*b* of the first conductive layer 21 and the second end portion 23*b* of the third conductive layer 23, and the fourth conductive layer 25 being tapered from a maximum width at the second end portion 25*b* thereof to a minimum width at the first end portion 25*a* thereof, the balun can transform balanced mode into unbalanced mode over a wide frequency range. The balun can also facilitate the connection of itself with an electronic circuit, such as an IC, having a pair of balanced output terminals in the same plane between the laminated substrates having a triplate structure. Furthermore, like the balun of the above-mentioned first embodiment, the balun according to the sixth embodiment of the present invention makes it possible to effectively use outputs from the pair of balanced output terminals of the electronic circuit without connecting one of the pair of balanced output terminals to a grounded surface of the laminated substrates by way of a termination, thereby preventing the operating status of the electronic circuit from becoming unstable, and improving the efficiency of a semiconductor device including the electronic circuit and an optical module including an optical semiconductor component that is driven by the electronic circuit or that outputs a high-frequency signal to the electronic circuit.

Numerous variants may be made in the sixth embodiment shown. As in the case of the above-mentioned third embodiment, each of the third and fourth conductive layers 23 and 25 can have a strip segment including the first end portion having a width smaller than that of the second end portion 22*b* of the second conductive layer 22.

The taper of each of the third and fourth conductive layers 23 and 25 of the balun 1 according to the sixth embodiment is not limited to a linear one and can be optimized so as to minimize the amount of reflection due to changes in the characteristic impedance of the balun 1. In other words, the taper of each of the third and fourth conductive layers 23 and 25 can be, as to shifting characteristic impedance, an exponential taper, a triangular taper, a curved taper such as a Klopfenstein taper, or any other taper which can reduce the amount of reflection while transforming the characteristic impedance of a balanced line into the characteristic impedance of an unbalanced line over a large frequency band, other than a linear taper. In this case, each of the first end portions 23*a* and 25*a* of the third and fourth conductive layers 23 and 25 of the balun 1 can have a width smaller than that of the second end portion 22*b* of the second conductive layer 22, as in the case of the above-mentioned third embodiment.

Many widely different embodiments of the present invention may be constructed without departing from the spirit and scope of the present invention. It should be understood that the present invention is not limited to the specific embodiments described in the specification, except as defined in the appended claims.

What is claimed is:

1. A balun comprising:

a first conductive layer formed as a rectangular strip and disposed on a top surface of a substrate, said first conductive layer having first and second end portions;

a second conductive layer formed as a rectangular strip and having a shorter length than said first conductive layer and disposed on the top surface of said substrate, said second conductive layer having first and second end portions, the first end portion of said second conductive layer serving as a balanced transmission line in cooperation with the first end portion of said first conductive layer;

said substrate having a through hole electrically connected to the second end portion of said second conductive layer; and a third conductive layer disposed on a bottom surface of said substrate, said third conductive layer having a first end portion electrically connected to the second end portion of said second conductive layer via said through hole, and a second end portion that serves as an unbalanced transmission line in cooperation with the second end portion of said first conductive layer, and said third conductive layer being tapered from a maximum width at the second end portion thereof to a minimum width at the first end portion thereof.

2. The balun according to claim 1, wherein the taper of said third conductive layer is a curved taper.

3. The balun according to claim 2, wherein the taper of said third conductive layer is a Klopfenstein taper as to shifting characteristic impedance.

4. The balun according to claim 1, wherein the first end portion of said third conductive layer has a width smaller than that of the second end portion of said second conductive layer.

5. The balun according to claim 4, wherein said third conductive layer includes a strip segment having a certain width smaller than that of the second end portion of said second conductive layer, and extending from the first end portion of said third conductive layer.

6. The balun according to claim 1, wherein the second end portion of said third conductive layer has a width that is at least from four to five times as large as that of the second end portion of said first conductive layer.

7. The balun according to claim 1, wherein the second end portion of said third conductive layer has a width that is substantially equal to a diameter of an outer conductor of a coaxial cable to be electrically connected to the second end portion of said third conductive layer.

8. The balun according to claim 1, wherein said third conductive layer has a length equal to or greater than one-half of a wavelength of a microwave to be transmitted through said balun.

9. A balun comprising:

a first conductive layer disposed on a top surface of a substrate, said first conductive layer having first and second end portions, and said first conductive layer being tapered from a maximum width at the second end portion thereof to a minimum width at the first end portion thereof;

a second conductive layer formed as a rectangular strip and having a shorter length than said first conductive layer and disposed on the top surface of said substrate, said second conductive layer having first and second end portions, the first end portion of said second conductive layer serving as a balanced transmission line in cooperation with the first end portion of said first conductive layer;

said substrate having a through hole electrically connected to the second end portion of said second conductive layer; and a third conductive layer formed as a rectangular strip and disposed on a bottom surface of said substrate, said third conductive layer having a first end portion electrically connected to the second end portion of said second conductive layer via said through hole, and a second end portion that serves as an unbalanced transmission line in cooperation with the second portion of said first conductive layer.

10. The balun according to claim 9, wherein the taper of said first conductive layer is a curved taper.

11. A balun comprising:

first and second substrates that are laminated;

a first conductive layer disposed between said first and second substrates, said first conductive layer having first and second end portions;

a second conductive layer having a shorter length than said first conductive layer and disposed between said first and second substrates, said second conductive layer having first and second end portions, the second end portion of said second conductive layer serving as a balanced transmission line in cooperation with the first end portion of said first conductive layer;

said laminated first and second substrate having a through hole electrically connected to the second end portion of said second conductive layer;

a third conductive layer disposed on a top surface of said laminated first and second substrates, said third conductive layer having a first end portion electrically connected to the second end portion of said second conductive layer via said through hole, and a second end portion that serves as an unbalanced triplate transmission line in cooperation with the second end portion of said first conductive layer, and said third conductive layer being tapered from a maximum width at the second end portion thereof to a minimum width at the first end portion thereof; and a fourth conductive layer disposed on a bottom surface of said laminated first and second substrates, said fourth conductive layer having a first end portion electrically connected to the second end portion of said second conductive layer via said through hole, and a second end portion that serves as the unbalanced triplate transmission line in cooperation with the second end portion of said first conductive layer and the second end portion of said third conductive layer, and said fourth conductive layer being tapered from a maximum width at the second end portion thereof to a minimum width at the first end portion thereof.

12. The balun according to claim 11, wherein each of the tapers of said third and fourth conductive layers is a curved taper.

13. The balun according to claim 11, wherein each of the first end portions of said third and fourth conductive layers has a width smaller than that of the second end portion of said second conductive layer.

14. A semiconductor device comprising:

an electronic circuit disposed on a top surface of a substrate, said circuit having a pair of balanced terminals;

a balun formed on said substrate, for connecting said pair of balanced terminals to an unbalanced transmission line, said balun including a first conductive layer formed as a rectangular strip and disposed on the top surface of said substrate, said first conductive layer having a first end portion connected to a terminal of said pair of balanced output terminals of said electronic circuit, and a second end portion, a second conductive layer formed as a rectangular strip and having a shorter length than said first conductive layer and disposed on the top surface of said substrate, said second conductive layer having a first end portion connected to the other terminal of said pair of balanced output terminals of said electronic circuit, and a second end portion, said substrate having a through hole electrically connected to the second end portion of said second conductive layer, and a third conductive layer disposed on a bottom surface of said substrate, said third conductive layer having a first end portion electrically connected to the second end portion of said second conductive layer via said through hole, and a second end portion that serves as said unbalanced transmission line in cooperation with the second end portion of said first conductive layer, and said third conductive layer being tapered from a maximum width at the second end portion thereof to a minimum width at the first end portion thereof; and an electronic module mounted on said substrate, for transmitting or receiving a signal to or from said electronic circuit by way of said balun.

15. The semiconductor device according to claim 14, further comprising a coaxial cable for electrically connecting said balun to said electronic module.

16. The semiconductor device according to claim 14, wherein said electronic module is electrically insulated from a ground of said substrate.

17. The semiconductor device according to claim 16, wherein said electronic module transmits or receives a high-frequency signal to or from said electronic circuit by way of said balun, and a high-frequency signal line of said electronic module is electrically insulated from the ground of said substrate.

18. The semiconductor device according to claim 16, wherein said electronic module is connected to said substrate by way of an insulating member.

19. The semiconductor device according to claim 14, wherein said electronic module is an optical module driven by a pair of signals supplied, by way of said balun, from said electronic circuit.

* * * * *